US011192143B2

(12) United States Patent
Tresse et al.

(10) Patent No.: US 11,192,143 B2
(45) Date of Patent: Dec. 7, 2021

(54) SORTING METHOD MADE FLEXIBLE BY PREPARING A DISTRIBUTION OF ARTICLES TO BE SORTED IN ANTICIPATION

(71) Applicant: SOLYSTIC, Bagneux (FR)

(72) Inventors: Didier Tresse, Saint Laurent d'Onay (FR); François Madar, Bourg les Valence (FR); Bertrand Latombe, Bouge Chambalud (FR)

(73) Assignee: SOLYSTIC, Bagneux (FR)

( * ) Notice: Subject to any disclaimer, the term of this patent is extended or adjusted under 35 U.S.C. 154(b) by 160 days.

(21) Appl. No.: 16/804,438

(22) Filed: Feb. 28, 2020

(65) Prior Publication Data

US 2020/0276615 A1 Sep. 3, 2020

(30) Foreign Application Priority Data

Feb. 28, 2019 (FR) ..... 1902051

(51) Int. Cl.
*B07C 1/02* (2006.01)

(52) U.S. Cl.
CPC ..... *B07C 1/02* (2013.01)

(58) Field of Classification Search
CPC ..... B07C 1/02; B07C 3/00; B07C 3/02
See application file for complete search history.

(56) References Cited

U.S. PATENT DOCUMENTS 6,107,588 A * 8/2000 De Leo ..... B07C 3/02 209/583
7,060,926 B2 * 6/2006 Edmonds ..... B07C 3/00 209/584
7,170,024 B2 * 1/2007 Burns ..... B07C 1/02 198/347.1
7,282,658 B2 * 10/2007 Hanson ..... B07C 3/00 209/584
7,528,339 B2 * 5/2009 Hanson ..... B07C 1/18 209/584

(Continued)

FOREIGN PATENT DOCUMENTS

WO WO-2009035694 A1 * 3/2009 ..... B07C 5/00

*Primary Examiner* — Patrick H Mackey
(74) *Attorney, Agent, or Firm* — Ware, Fressola, Maguire & Barber LLP

(57) ABSTRACT

A method of sorting articles by means of a sorting system comprising N sorting machines ($M_1$, $M_N$) operating in parallel, in which method the articles are divided into N groups ($G_1$, $G_N$) of articles to be processed in parallel on the N sorting machines, at least one of the N groups of articles is subdivided into sub-groups of articles ($G_{1.1}$, $G_{1.N-1}$), and, if it is detected that one of the N machines is being rested, then the method comprises the steps of: feeding the N−1 other sorting machines with the sub-groups of articles from said subdivided group of articles and sorting these sub-groups of articles in parallel on the N−1 other sorting machines; and feeding the N−1 other sorting machines with the N−1 other groups of articles and sorting these N−1 groups of articles in parallel on said N−1 other sorting machines.

4 Claims, 3 Drawing Sheets

(56) References Cited

U.S. PATENT DOCUMENTS

| | | | | |
|---|---|---|---|---|
| 7,663,072 | B2 * | 2/2010 | Conard | B07C 3/00 209/584 |
| 7,728,245 | B2 * | 6/2010 | Redford | B07C 3/00 209/584 |
| 2020/0276616 | A1 * | 9/2020 | Tresse | B07C 5/38 |

* cited by examiner

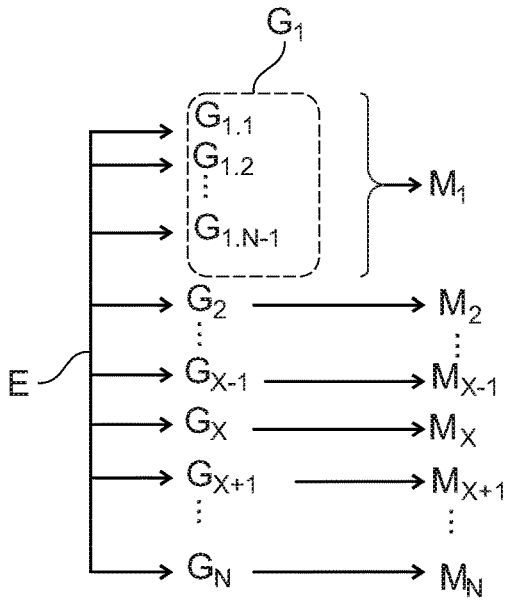
Fig. 2A.1
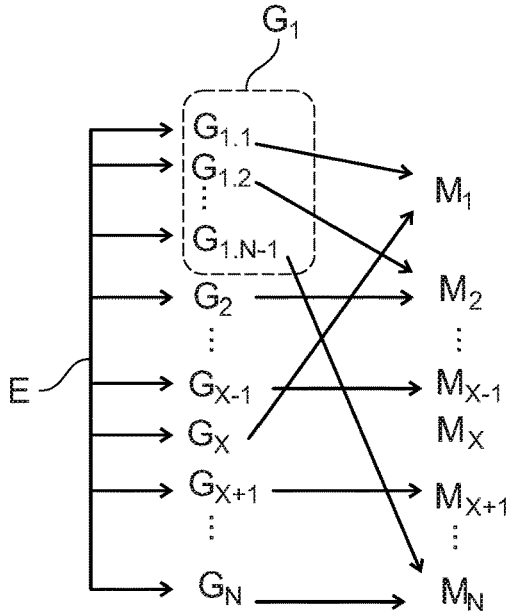
Fig. 2A.2
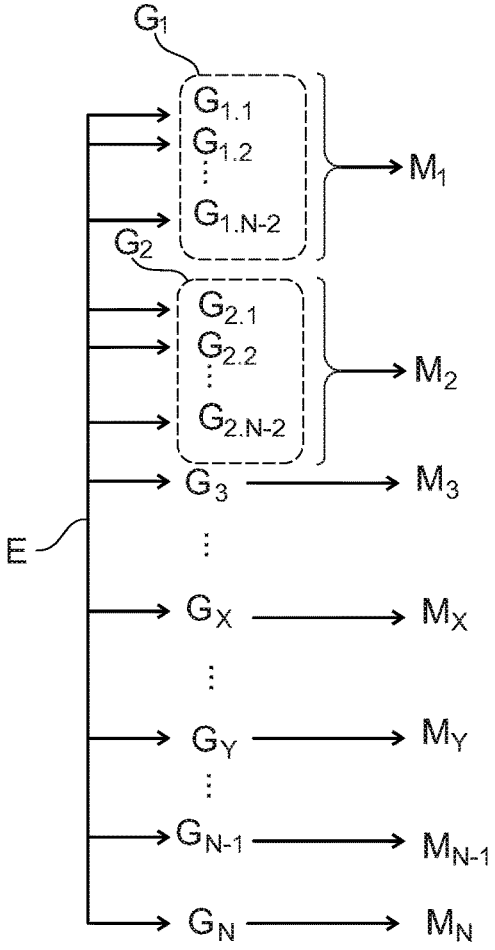
Fig. 2B.1
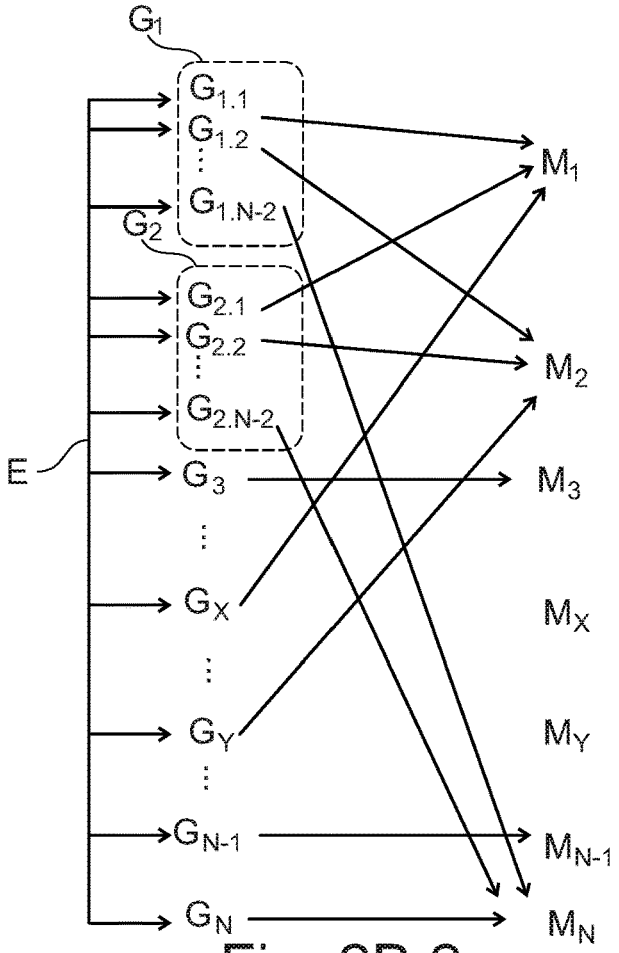
Fig. 2B.2

SORTING METHOD MADE FLEXIBLE BY PREPARING A DISTRIBUTION OF ARTICLES TO BE SORTED IN ANTICIPATION

CROSS REFERENCE TO RELATED APPLICATIONS

This application claims priority under 35 USC § 119 to French Patent Application No. 1902051 filed on Feb. 28, 2019, which application is hereby incorporated by reference in its entirety.

TECHNICAL FIELD

The invention relates to the field of methods of sorting articles by means of sorting machines operating in parallel.

PRIOR ART

In order to receive postal articles coming from various sources and in order to deliver them to a large number of recipients, postal organizations firstly gather the received articles together and, as a function of the geographical regions of their destinations, route them or "outwardly sort" them towards sorting centers, where they are arranged in delivery sequences.

At the sorting centers, a set of articles to be delivered undergoes an "inward sorting" phase, during which the set of articles is separated into groups, each group corresponding to a delivery geographical sector, and then undergoes a "sequencing" phase, during which each group is processed individually on a dedicated sorting machine so as to arrange the articles into sequences, typically so as to prepare delivery rounds or "postmen's walks", also known as "mail carrier walks".

Each group of articles corresponds to a set of delivery rounds that is defined in predetermined and static manner, as a function of the geography of the region covered, and each group of articles is processed by a machine that is determined in advance as a function of the delivery addresses of the articles in the group.

Typically, the groups of articles are processed simultaneously on sorting machines that operate in parallel.

Reference may be made to U.S. Pat. No. 7,170,024, which discloses a method of sorting articles into sequences that includes sorters working in parallel.

Conventionally, the number of groups determines the number of sorting machines that are to be used during the sequencing phase, and does not allow any flexibility for adapting to different circumstances, such as lowness of volume to be processed and/or failure of a sorting machine.

Certain methods of preparing sequencing plans are based on predicting the volumes to be processed, but they lead to errors consisting in over- or under-estimating the volume to be processed, and thus in activating too many or too few sorting machines.

The problem of failure of a sorting machine is critical, leading to it being impossible for the group that was assigned to the failed sorting machine to be processed at the scheduled time, with the ensuing risk that the articles making up the group might not be delivered on time.

Methods of mitigating failure of a sorting machine consist in over-dimensioning the fleet of sorting machines, which requires acquiring more sorting machines than necessary and keeping them operational at all times.

Reference may be made to International Patent Application WO 2009/035694 A1, which discloses such a method.

The existing solutions remain unsatisfactory in terms of enabling the number of sorting machines that are to be used to be dynamically adapted to accommodate changes in workload and failure of one or more sorting machines.

SUMMARY OF THE INVENTION

An object of the invention is to provide a method that enables use of sorting machines operating in parallel to be adapted to accommodate the real workload and/or the unforeseen unavailability of one or more sorting machines.

To this end, the invention provides a method of sorting articles in a sorting center, by means of a sorting system comprising N sorting machines operating in parallel and having sorting outlets, in which method the articles are divided into N groups of articles to be processed in parallel on the N sorting machines, and in which method at least one of the N groups of articles is subdivided into sub-groups of articles, and, if it is detected that one of the N machines is being rested, then the method comprises the steps of:

- feeding the N−1 other sorting machines with the sub-groups of articles from said subdivided group of articles and sorting these sub-groups of articles in parallel on the N−1 other sorting machines; and
- feeding the N−1 other sorting machines with the N−1 other groups of articles and sorting these N−1 groups of articles in parallel on the N−1 other sorting machines. Thus N is a proactive integer greater than 1.

The sorting method of the invention offers the advantage of making it possible, by means of a subdivision of at least one of the groups of articles in anticipation, for the articles that are to be processed to be redistributed between the sorting machines and thus, whenever necessary, for the workload to be distributed, i.e. shared out, over a reduced number of sorting machines.

Furthermore, this redistribution of the articles may be implemented very late, up until after the articles to be processed have been separated into groups, thereby making it possible to take into account the real number of articles to be processed and/or to take into account a failure of at least one of the sorting machines even when said failure is detected very late, thereby imparting a dynamic aspect to how the sorting of the articles is organized.

The sorting method of the invention may have the following features:

- at least two of the N groups of articles may be subdivided into sub-groups of articles, and, if it is detected (T) that two of the N machines are being rested, then the method may comprise the steps of:
  - feeding the N−2 other sorting machines with the sub-groups of articles from one of said subdivided groups of articles and sorting these sub-groups of articles in parallel on the N−2 other sorting machines;
  - feeding the N−2 other sorting machines with the sub-groups of articles from the other of said subdivided groups of articles and sorting these sub-groups of articles in parallel on the N−2 other sorting machines; and
  - feeding the N−2 other sorting machines with the N−2 other groups of articles and sorting these N−2 groups of articles in parallel on the N−2 other sorting machines; and
- the articles may be postal articles.

BRIEF DESCRIPTION OF THE DRAWINGS

The present invention can be better understood and other advantages appear on reading the following detailed description of an implementation given by way of non-limiting example and with reference to the accompanying drawings, in which:

FIGS. 2A1 to 2B2 diagrammatically show distributions of the invention for articles to be sorted on the sorting machines of FIG. 1.

DESCRIPTION OF AN IMPLEMENTATION OF THE METHOD OF THE INVENTION

Figure 1:
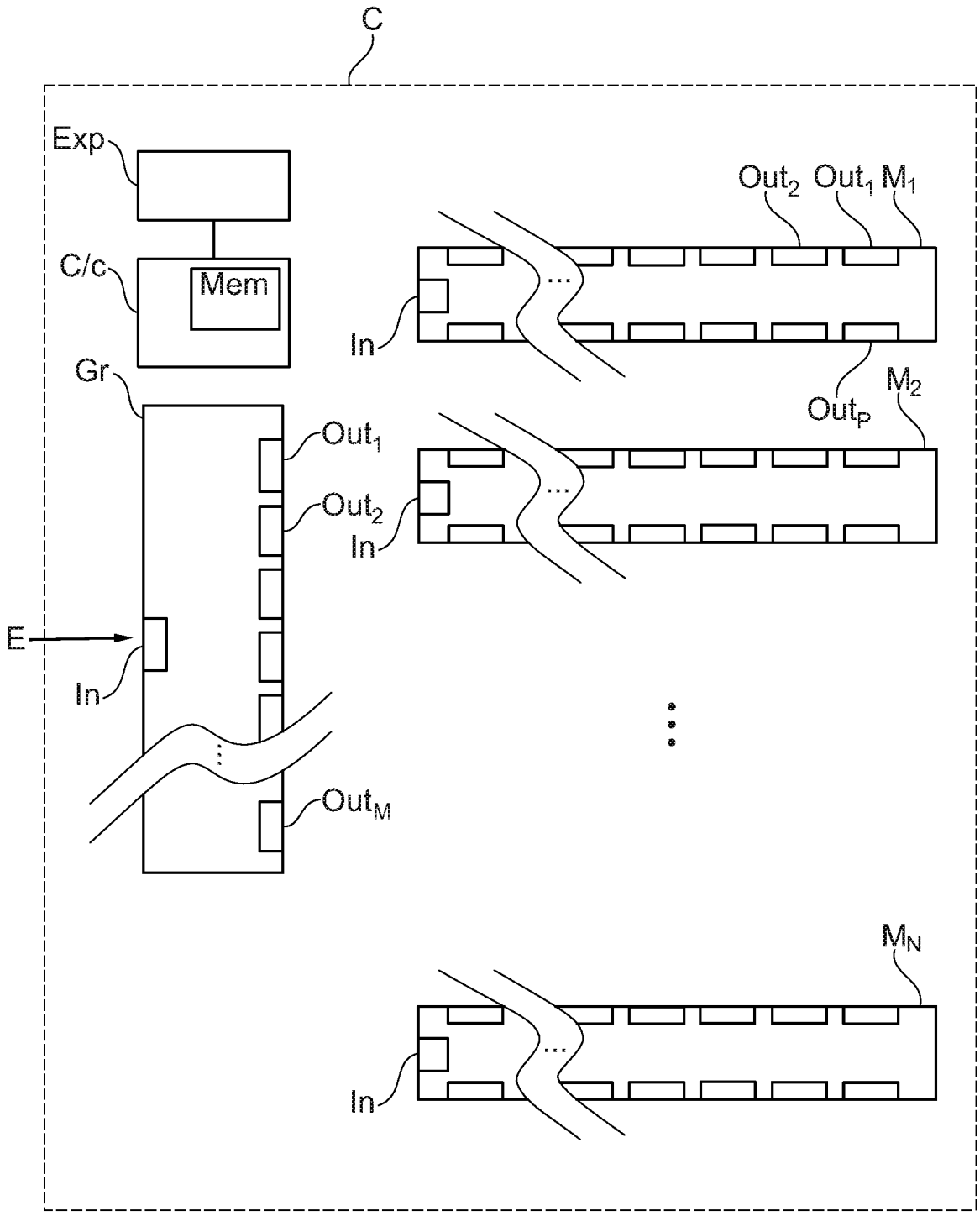
FIG. 1 diagrammatically shows an article sorting system comprising sorting machines in parallel.

FIG. 1 shows a sorting system that can be used for implementing the method of the invention.

In this implementation, the method is incorporated into preparing delivery rounds for articles arriving at the inlet of a sorting system.

These articles may be letter-type mailpieces to be delivered to their respective recipients, or indeed parcels to be delivered to their purchasers following mail orders or more typically e-commerce orders placed via the Internet.

The sorting system comprises a grouping machine Gr for grouping together a set E of articles to be processed, with an inlet In and a plurality of outlets referenced $Out_1$ to $Out_M$, and sorting machines $M_1$ to $M_N$, operating in parallel, each having one inlet In and a plurality of outputs referenced $Out_1$ to $Out_P$.

The grouping machine Gr and the sorting machines may be equipped with sensors that are connected to a monitoring and control system C/c, and that are organized to identify and track the articles to be sorted, using conventional methods.

The grouping machine Gr and the sorting machines $M_1$ to $M_N$ may be sorters of the same type or sorters of different types.

The grouping machine Gr is configured to form groups of articles at its outlets, which groups of articles are constituted by articles from the set E of articles to be processed, e.g. by sorting said articles as a function of their destination addresses and/or of the delivery rounds to which they are assigned.

The grouping machine Gr is preferably equipped with one or more counters serving to count the articles it processes in order to assess the sorting workload represented by the articles to be processed from the set E.

The sorting machines $M_1$ to $M_N$ are fed at their respective inlets with the groups of articles formed at the outlets of the grouping machine Gr and they are configured to form delivery rounds, i.e. ordered sequences of articles to be delivered according to their destination addresses.

Conveying the articles from the outlets of the grouping machine Gr to the inlets of the sorting machines may be performed by hand, by means of conveyors and/or of mechanisms that are fully or partially automated, or indeed by means of shuttle robots, using methods known to the person skilled in the art.

The monitoring and control unit C/c controls the grouping machine Gr, the sorting machines $M_1$ to $M_N$, and, where applicable, the means for conveying the articles between the machines.

The monitoring and control unit C/c includes a computer memory Mem storing sorting plans that establish correspondences between the destination addresses on the articles, the delivery rounds, and the sorting machines and their respective outlets.

The monitoring and control unit defines the groups of articles to be formed at the outlets of the grouping machine Gr on the basis of the set of articles to be processed, and controls the sorting machines and the conveyor means in such a manner that the sorting complies with the sorting plans stored in the computer memory, which includes the distribution of the groups of articles formed at the outlets of the grouping machine to the inlets In of the sorting machines $M_1$ to $M_N$.

Each article to be sorted is assigned to a delivery round as a function of its destination address, and each delivery round is assigned to one of the outlets of one of the sorting machines and to one of the groups of articles that is formed at a given outlet of the grouping machine.

Thus, the monitoring and control unit controls conveying of the articles from the outlets of the grouping machine Gr to the inlets of the sorting machines in such a manner that each group of articles is brought to the inlet of the sorting machine that is scheduled to process the articles.

In a conventional sorting method, a set of articles is divided into groups of articles to be processed in parallel by sorting machines, one group per machine, and the groups are assigned to the sorting machines statically, the sorting machine that processes any given article being determined by the destination address of said given article, independently of criteria that can vary, such as the flow of articles to be processed or the state of the fleet of sorting machines.

Such organization makes the way the sorting is organized very rigid, and prevents any adaptation to accommodate variations in the number of articles to be processed or to accommodate contingencies such as untimely failure of one or more sorting machines.

Advantageously, the method of the invention imparts flexibility to the organization, and enables the way in which the articles to be sorted are distributed between the sorting machines to be changed dynamically.

Figure 3:
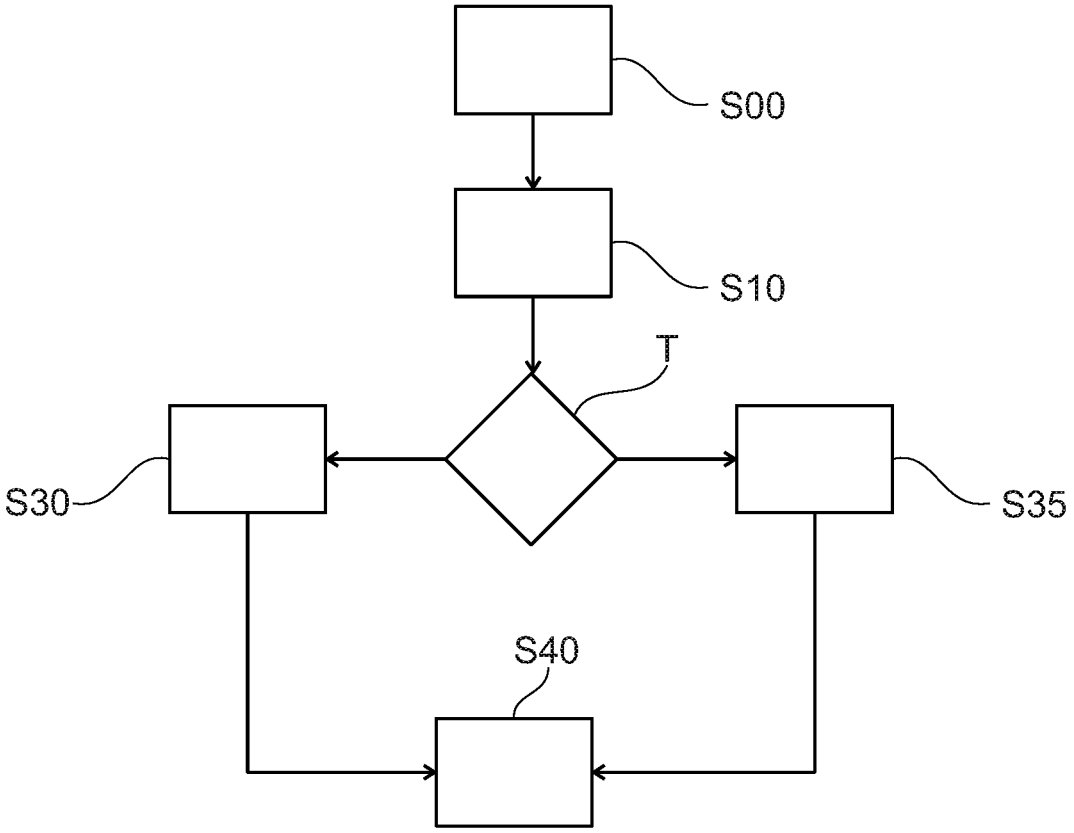
FIG. 3 is a flow chart of the sorting method of the invention, as implemented by means of the system shown in FIG. 1.

More specifically, in accordance with the invention, a set E of articles to be processed is received at the sorting center C at step S00, then, at step S10, the grouping machine Gr divides the set E of articles into N groups of articles that are to be processed in parallel by the N sorting machines, at least one of the N groups of articles to be processed also being subdivided into sub-groups of articles that are to be distributed among the sorting machines in parallel, as need be, or as decided by the operator of the sorting system, as described in detail below and as shown in FIG. 3.

In this document, saying that a group is subdivided into sub-groups is equivalent to saying that the group is made up of sub-groups, and distributing the groups or the sub-groups means that said groups or sub-groups are preferably distributed in such a manner that, as far as possible, the workload that they represent is distributed, i.e. shared out, uniformly between the machines that are assigned to processing them.

FIG. 2A.1 shows the situation in which the grouping machine GR divides a set E of articles into N groups $G_1$ to $G_N$ during step S10, these groups being to be processed in parallel, each being to be processed by a respective one of the N sorting machines $M_1$ to $M_N$ operating in parallel.

In this embodiment, the group G1 is formed by N−1 sub-groups $G_{1.1}$ to $G_{1.N-1}$, which amounts to saying that the group $G_1$ is subdivided into sub-groups $G_{1.1}$ to $G_{1.N-1}$.

Furthermore, the set E of articles is processed by the grouping machine Gr, and the groups $G_2$ to $G_N$ and the sub-groups $G_{1.1}$ to $G_{1.N-1}$ are formed at respective ones of the outlets of said grouping machine.

The number M of outlets of the grouping machine Gr must therefore be greater than or equal to 2N−2.

It can be desirable or obligatory not to use all N sorting machines, and so the method of the invention includes a test step T for determining which sorting machines should actually be used, and which should be rested.

This determination may be performed by an expert system Exp in communication with the monitoring and control unit and/or with the counter(s) of the grouping machine Gr and/or by a human, such as, for example, the operator of the sorting system, as a function of the quantity of articles to be processed, as assessed by the grouping machine after the groups of articles have been formed and/or by a signal emitted by one of the sorting machines and indicating a failure of that sorting machine to the monitoring and control unit.

If, in response to the test step T, the monitoring and control unit determines that all of the sorting machines do indeed have to be used, then, the method goes to sorting step S30, which is shown by FIG. 2A.1, and in which the monitoring and control unit controls the sorting system in compliance with a first sorting plan in such a manner as to bring the groups $G_1$ to $G_N$ from the outlets of the grouping machine Gr to respective ones of the inlets of the N sorting machines $M_1$ to $M_N$ that process respective ones of these groups of articles in parallel and in such a manner as to prepare the delivery rounds.

More specifically, the articles in the N−1 sub-groups $G_{1.1}$ to $G_{1.N-1}$ are brought to the inlet of the sorting machine $M_1$ from the N−1 outlets of the grouping machine Gr where they were formed, and the articles in the N−1 groups $G_2$ to $G_N$ are brought to respective ones of the inlets of the sorting machines $M_2$ to $M_N$ from N−1 other outlets of the grouping machine Gr where they were formed.

If, in response to the test step T, the monitoring and control unit determines that only N−1 of the sorting machines are to be used, and that one machine, e.g. the machine $M_X$, is to be rested, then the method goes to step S35, which is shown in FIG. 2A.2, and in which the monitoring and control unit controls the sorting system in compliance with a second sorting plan in such a manner that (i) respective ones of the N−1 other sorting machines are fed with the N−1 sub-groups of articles $G_{1.1}$ to $G_{1.N-1}$ of said group of articles $G_1$ that is subdivided so as to sort said sub-groups of articles in parallel on the N−1 other sorting machines, and that (ii) respective ones of the N−1 other sorting machines are fed with the N−1 other groups of articles $G_2$ to $G_N$ so as to sort said N−1 groups of articles in parallel on the N−1 other sorting machines.

FIG. 2A.2 shows that the sub-groups of articles $G_{1.1}$ to $G_{1.N-1}$ are brought to respective ones of the inlets of the sorting machines $M_1$ to $M_N$ with the exception of the sorting machine $M_X$ that is being rested and that was scheduled to process the group $G_X$, where $M_X$ and $G_X$ designate respectively the $X^{th}$ sorting machine and the $X^{th}$ group of articles, X being an integer less than N.

In any event, after the sorting, the articles are retrieved at the outlets of the sorters in the form of delivery sequences in a step S40, optionally packaged, and then dispatched to their destinations in compliance with the delivery round to which they belong, by conventional methods.

An advantage of the method of the invention is to make it possible to rest one of the machines when the number of articles to be processed is small compared with the nominal capacity of the sorting system, rather than using the entire set of machines below capacity.

The method also imparts great robustness to the sorting system in coping with untimely failure of one of the sorting machines, compared with conventional systems.

In conventional systems, failure of one of the machines requires the processing of the group of articles that should have been processed by the failed machine to be postponed until one of the other sorting machines becomes free, which leads to a considerable delay in the sorting, giving rise to a risk of the articles not being delivered on time, and disorganizing the delivery chain, in particular with regard to the availabilities of transporters, delivery persons and/or mail carriers.

Conversely, the method of the invention enables the workload to be distributed dynamically in advantageous manner due to sub-groups being prepared in advance that can be distributed among the sorting machines according to needs, it being possible for the decision on the distribution to use to be made very late, up until the time at which the groups of articles need to be conveyed from the outlets of the grouping machine Gr to the inlets of the sorting machines, after the groups and the sub-groups have been formed.

The number N of sorting machines operating in parallel in a sorting system generally varies from 15 to 50, which means that the distribution of the workload from one of the sorting machines to the others causes an increase of in the range 1/50 to 1/15 of the workload of each machine compared with using all of the sorting machines.

Such an increase is compatible with the leeway provided when planning the operations, so that even untimely failure of a machine does not give rise to a risk of the articles not being delivered on time.

In this implementation, the Group $G_X$ may be brought specifically to the inlet of the machine $M_1$ scheduled to process the group of articles $G_1$ when all of the sorting machines $M_1$ to $M_N$ are used, and the groups $G_2$ to $G_N$ except for the group $G_X$ may be brought respectively to the inlets of the machines $M_2$ to $M_N$ except for the machine $M_X$ that are scheduled to process the same groups of articles when all of the sorting machines $M_1$ to $M_N$ are used, as shown in FIG. 2A.2.

The invention is not limited to such a distribution, but this particular distribution of the groups between the sorting machines offers the advantage of limiting the changes in how the sorting is organized, since only those articles for which the processing must be changed in order to take into account the new constraints have their handling actually changed.

The method shown in FIGS. 2A.1 and 2A.2 may be generalized to situations in which more than one sorting machine is being rested, as shown by FIGS. 2B.1 and 2B.2 showing the preparation of two groups $G_1$ and $G_2$ into sub-groups and their distributions over all of the sorting machines in a normal situation (FIG. 2B.1) and in the situation in which two machines $M_X$ and $M_Y$ are being rested (FIG. 2B.2).

In this situation, each of the two groups of articles $G_1$ and $G_2$ is subdivided into N−2 sub-groups $G_{1.1}$ to $G_{1.N-2}$ and $G_{2.1}$ to $G_{2,N-2}$, respectively.

Thus, as in the preceding situation, when the number of articles to be processed corresponds to the capacity of the sorting machines and when all of the machines are actually used, the groups $G_1$ to $G_N$ are brought to respective ones of the inlets of the N sorting machines, as shown by FIG. 2B.1, and then processed respectively in parallel.

As regards the subdivided groups $G_1$ and $G_2$, the sub-groups $G_{1.1}$ to $G_{1.N-2}$ constituting the group $G_1$ are brought to the inlet of the sorting machine $M_1$ and the sub-groups $G_{2.1}$ to $G_{2.N-2}$ constituting the group $G_2$ are brought to the inlet of the sorting machine $M_2$.

When two machines, the machines $M_X$ and $M_Y$ in this example, are being rested, then the monitoring and control unit controls the sorting system in such a manner that (i) the N−2 other sorting machines are fed with the N−2 sub-groups of articles $G_{1.1}$ to $G_{1.N-2}$ of the subdivided group of articles $G_1$ so as to sort these sub-groups of articles in parallel on the N−2 other sorting machines, (ii) the N−2 other sorting machines are fed respectively with the N−2 sub-groups of articles $G_{2.1}$ to $G_{2.N-2}$ of the subdivided group of articles $G_2$ so as to sort these sub-groups of articles in parallel on the other N−2 sorting machines, and (iii) the N−2 other sorting machines are also fed with respective ones of the N−2 other groups of articles $G_3$ to $G_N$ so as to sort these N−2 groups of articles in parallel on the N−2 other sorting machines.

FIG. 2B.2 shows such a situation, in which the sub-groups of articles $G_{1.1}$ to $G_{1.N-2}$ and $G_{2.1}$ to $G_{2.N-2}$ are brought to respective ones of the inlets of the sorting machines $M_1$ to $M_N$ with the exception of the sorting machines $M_X$ and $M_Y$ that are being rested and that were scheduled to process respective ones of the groups $G_X$ and $G_Y$, where $M_X$ and $M_Y$ designate respectively the $X^{th}$ sorting machine and the $Y^{th}$ sorting machine, X and Y being different integers less than N.

The groups $G_X$ and $G_Y$ may be brought to respective ones of the inlets of the machines $M_1$ and $M_2$ scheduled to process respective ones of the subdivided groups of articles $G_1$ and $G_2$ in the situation in which all of the sorting machines $M_1$ to $M_N$ are used, and the groups $G_3$ to $G_N$ except for the groups $G_X$ and $G_Y$ can be brought to respective ones of the inlets of the machines $M_3$ to $M_N$, except for the machines $M_X$ and $M_Y$, that are scheduled to process the same groups of articles when all of the sorting machines $M_1$ to $M_N$ are used, as shown by FIG. 2B.2.

The subdivision of two groups into N−2 sub-groups as shown in FIGS. 2B.1 and 2B.2 is compatible with the subdivision of a group into N−1 sub-groups as shown in FIGS. 2A.1 and 2A.2, suffice to consider that one of the N−2 sub-groups is made up of two of the N−1 sub-groups.

In addition, to accommodate the situation in which a single machine is being rested with two groups $G_1$ and $G_2$ each subdivided into N−2 sub-groups, it suffices, for example, to consider the group $G_2$ as not subdivided and to bring it to the inlet of the machine $M_2$, and to distribute the sub-groups of $G_1$ to N−2 machines among the N−1 available machines, one of these machines processing the group that is normally assigned to it without receiving any additional sub-group.

Generalizing the method to a larger number of sorting machines being rested is limited only by logistics constraints, in particular by the capacity of the grouping machine Gr assigned to separating the set of articles into groups of articles, each incrementation by one of the number of machines that can be rested increasing the number of groups formed by approximately the number of sorting machines working in parallel, at least when it is sought to form one group per outlet of the grouping machine and to distribute the workload over the entire fleet of sorting machines.

The grouping operation described above as performed by a single, dedicated machine may be performed by a plurality of machines performing the same grouping (same sorting plan for all of the grouping machines) and/or by one or more machines also assigned to preparing the delivery rounds ($M_1$ to $M_N$).

What is claimed is:

1. A method of sorting articles by a sorting system comprising N sorting machines operating in parallel and having sorting outlets, wherein the articles are divided into N groups of articles to be processed in parallel on the N sorting machines, at least one of the N groups of articles is subdivided into sub-groups of articles, and, if it is detected that one of the N machines is being rested, then the method comprises the steps of:

feeding the N−1 other sorting machines with the sub-groups of articles from said subdivided group of articles and sorting these sub-groups of articles in parallel on the N−1 other sorting machines; and feeding the N−1 other sorting machines with the N−1 other groups of articles and sorting these N−1 groups of articles in parallel on the N−1 other sorting machines.

2. The method of sorting articles according to claim 1, wherein at least two of the N groups of articles are subdivided into sub-groups of articles, and if it is detected that two of the N machines are being rested, then the method comprises the steps of:

feeding the N−2 other sorting machines with the sub-groups of articles from one of said subdivided groups of articles and sorting these sub-groups of articles in parallel on the N−2 other sorting machines;

feeding the N−2 other sorting machines with the sub-groups of articles from the other of said subdivided groups of articles and sorting these sub-groups of articles in parallel on the N−2 other sorting machines; and feeding the N−2 other sorting machines with the N−2 other groups of articles and sorting these N−2 groups of articles in parallel on the N−2 other sorting machines.

3. The method of sorting articles according to claim 2, wherein the articles are postal articles.

4. The method of sorting articles according to claim 1, wherein the articles are postal articles.

* * * * *